US011050198B1

(12) United States Patent
Cheng et al.

(10) Patent No.: US 11,050,198 B1
(45) Date of Patent: Jun. 29, 2021

(54) SOCKET CONNECTOR

(71) Applicant: TELEBOX INDUSTRIES CORP., Taipei (TW)

(72) Inventors: Chih-Yuan Cheng, Taipei (TW); Shiuan Ming Chang, New Taipei (TW)

(73) Assignee: TELEBOX INDUSTRIES CORP., Taipei (TW)

( * ) Notice: Subject to any disclaimer, the term of this patent is extended or adjusted under 35 U.S.C. 154(b) by 0 days.

(21) Appl. No.: 16/792,022

(22) Filed: Feb. 14, 2020

(30) Foreign Application Priority Data

Dec. 26, 2019 (TW) ..... 108147911

(51) Int. Cl.
*H01R 13/70* (2006.01)
*H01R 13/703* (2006.01)
*H01R 13/66* (2006.01)
*H01R 13/717* (2006.01)

(52) U.S. Cl.
CPC ..... *H01R 13/7036* (2013.01); *H01R 13/665* (2013.01); *H01R 13/7175* (2013.01)

(58) Field of Classification Search
CPC ..... H01R 13/703
See application file for complete search history.

(56) References Cited

U.S. PATENT DOCUMENTS

2012/0039573 A1* 2/2012 Moriarty ..... G02B 6/4292 385/88

* cited by examiner

*Primary Examiner* — Ross N Gushi
(74) *Attorney, Agent, or Firm* — Maschoff Brennan

(57) ABSTRACT

The disclosure provides a socket connector including a housing, a circuit board, an electronic device, a contact element, and a switch component. The housing has an insertion hole configured for an insertion of a plug connector. The circuit board is fixed in the insertion hole. The electronic component is disposed in the insertion hole. The contact element is located in the insertion hole. The contact element has a fixed end and a movable end, the fixed end is electrically connected to the circuit board, and the movable end is movable with respect to the circuit board. The switch component is movably located in the insertion hole and is in contact with the contact element. The switch component is configured to be movable by the plug connector so as to force the movable end of the contact element to electrically connect to or disconnect from the electronic component.

9 Claims, 12 Drawing Sheets

SOCKET CONNECTOR

CROSS-REFERENCE TO RELATED APPLICATIONS

This non-provisional application claims priority under 35 U.S.C. § 119(a) on Patent Application No(s). 108147911 filed in Taiwan, R.O.C. on Dec. 26, 2019, the entire contents of which are hereby incorporated by reference.

TECHNICAL FIELD

The disclosure relates to a socket connector, more particularly to a socket connector having a switch component or an electrical insulation component.

BACKGROUND

The Power over Ethernet (i.e., PoE) technology is widely used in various fields. It allows signals and electricity to be transmitted at the same time via a twisted pair cable or a RJ45 socket and plug, such that the electronic device can obtain electricity through PoE thereby omitting additional power cable and associated devices and thus saving the cost and time in manufacturing the electronic device.

In most cases, the RJ45 type socket connectors have a light-emitting element that can emit light for showing the condition of the socket. This has advantages, such as directly showing the availability of the PoE, or making it easy to find the cable connected thereto. The light-emitting element has a current limitation permitting for its normal operation. When the current transmitted between the PoE socket connector and plug exceeds the maximum current permitted for the light-emitting element, it will cause damage to the light-emitting element. Nowadays. the electronic products, such as IP phones, wireless routers, webcams, hubs, and computers, require higher current than ever to operate due to their largely improved performance, and which largely increases the cases of damaging the light-emitting element.

The malfunction of the light-emitting element inevitably causes negative customer reactions, and the manufactures shall recall the damaged products and refund or compensate the customers.

SUMMARY OF THE INVENTION

One embodiment of the disclosure provides a socket connector. The socket connector is configured for an insertion of a plug connector. The socket connector includes a housing, a circuit board, an electronic device, at least one contact element, and a switch component. The housing has an insertion hole configured for the insertion of the plug connector. The circuit board is fixed in the insertion hole. The electronic component is disposed in the insertion hole. The contact element is located in the insertion hole. The contact element has a fixed end and a movable end, the fixed end is electrically connected to the circuit board, and the movable end is movable with respect to the circuit board. The switch component is movably located in the insertion hole and is in contact with the contact element. The switch component is configured to be movable by the plug connector so as to force the movable end of the contact element to electrically connect to or disconnect from the electronic component.

Another embodiment of the disclosure provides a socket connector. The socket connector is configured for an insertion of a plug connector. The socket connector includes a housing, a circuit board, an electronic device, at least one contact element, and an electrical insulation component. The housing has an insertion hole configured for the insertion of the plug connector. The circuit board is fixed in the insertion hole. The electronic component is disposed in the insertion hole. The contact element is located in the insertion hole. The contact element has a fixed end, a movable end and a contact point. The fixed end is electrically connected to the circuit board, the movable end is movable with respect to the circuit board, and the contact point is located between the fixed end and the contact point. The contact element is configured to be movable by the plug connector so as to force the movable end of the contact element to electrically connect to or disconnect from the electronic component. The electrical insulation component is disposed in the insertion hole and movably located between the contact point of the contact element and an opening of the housing connected to the insertion hole. Before the contact element is electrically connected with the plug connector, the electrical insulation component is located between the plug connector and the contact element to electrically insulate the plug connector from the contact element.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
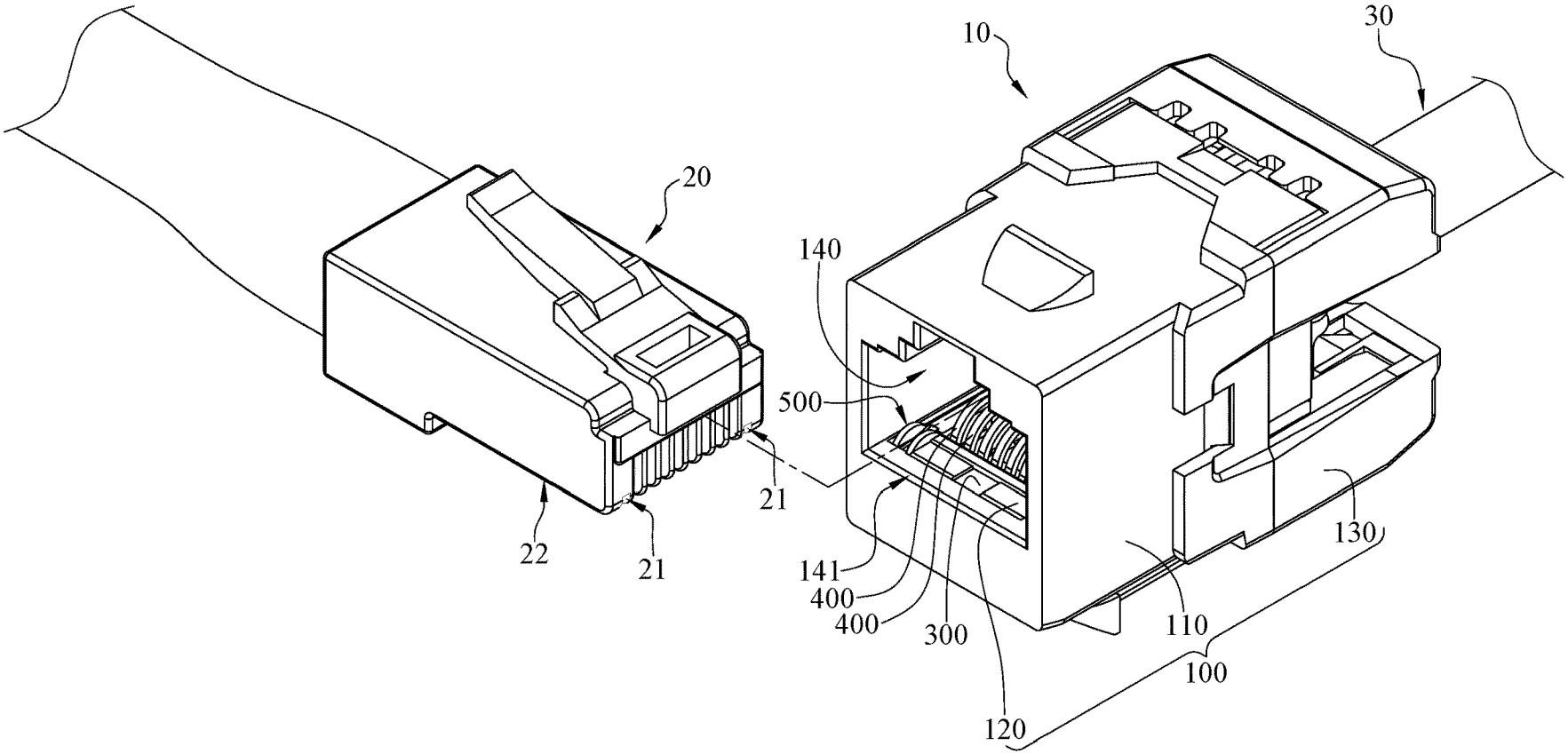
FIG. 1 is a perspective view of a socket connector and a plug connector according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure.

Figure 2:
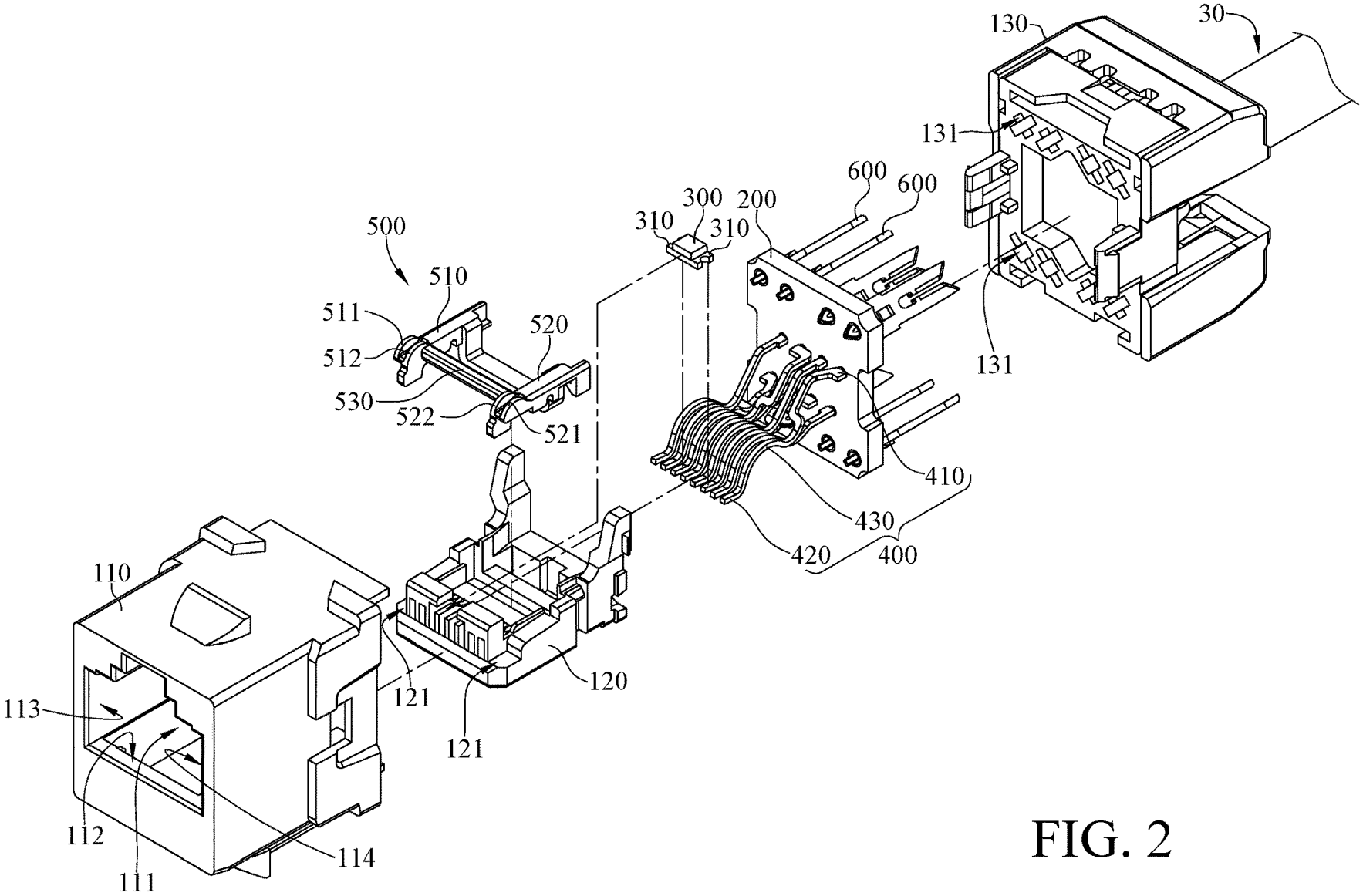
FIG. 2 is an exploded view of the socket connector in FIG. 1.
Figure 3:
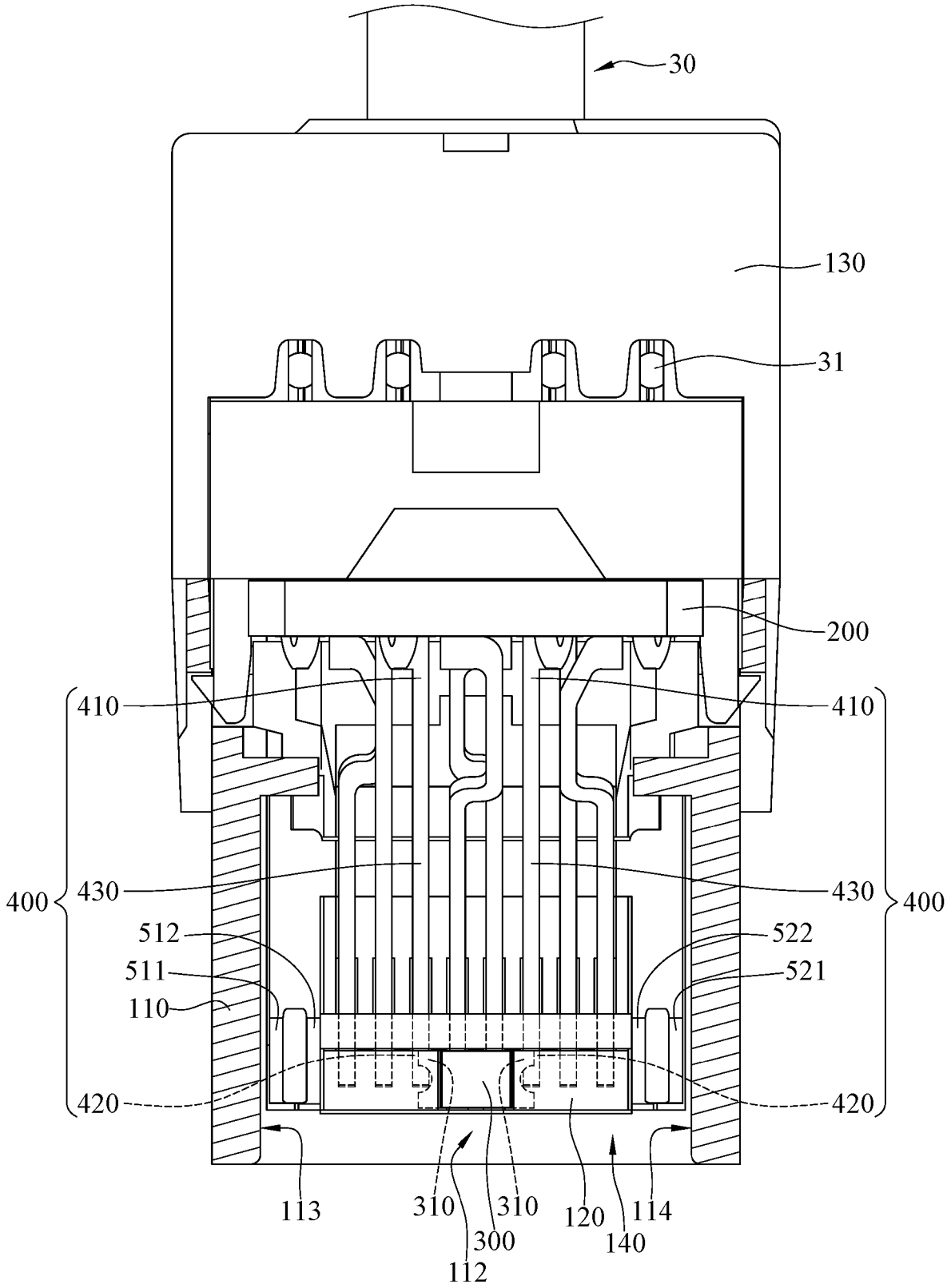
FIG. 3 is a cross-sectional view of the socket connector in FIG. 1.
Figure 4:
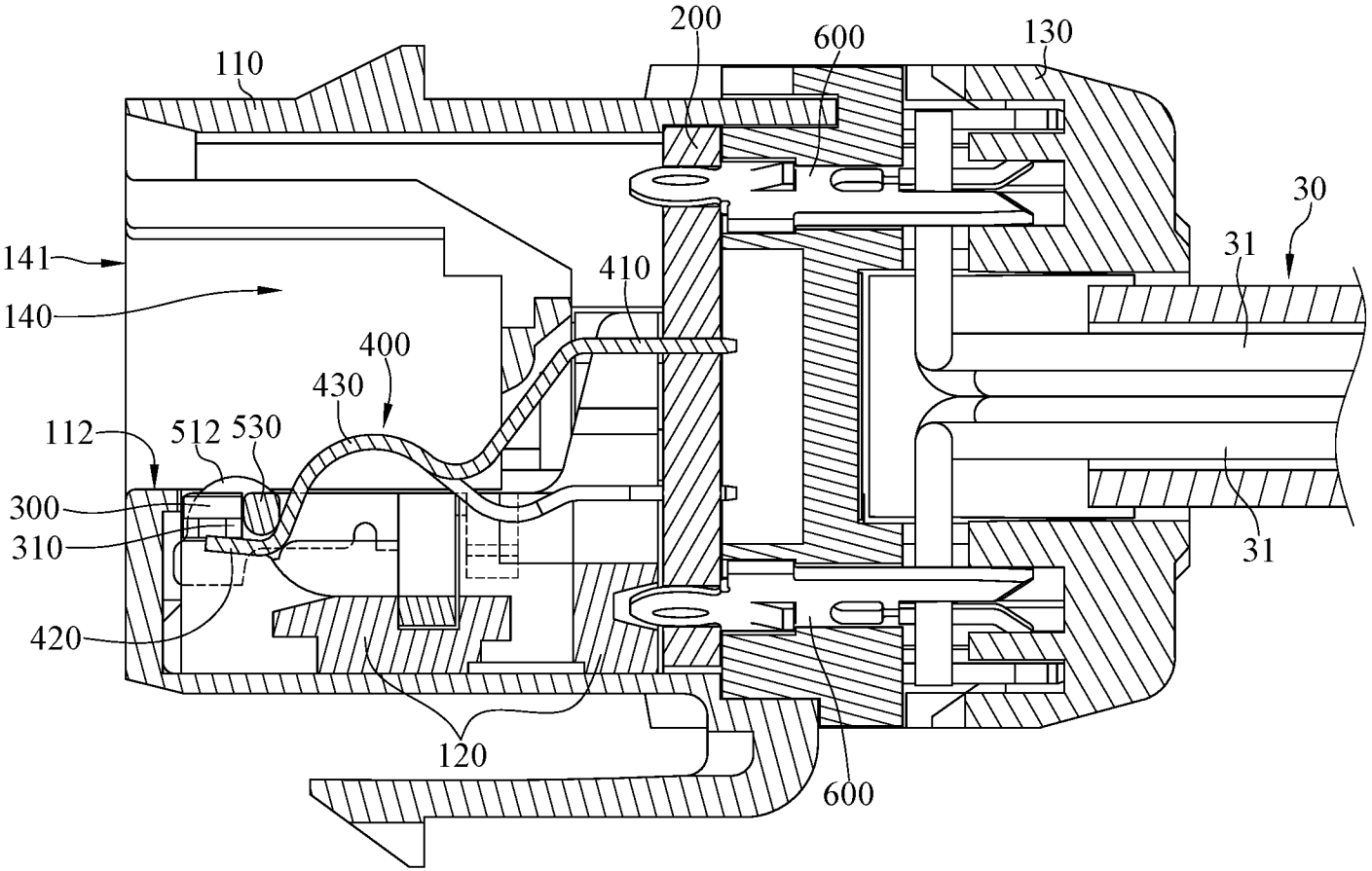
FIG. 4 is another cross-sectional view of the socket connector in FIG. 1.

Referring to FIGS. 1 to 4, where FIG. 1 is a perspective view of a socket connector 10 and a plug connector 20 according to a first embodiment of the disclosure; FIG. 2 is an exploded view of the socket connector 10 in FIG. 1, FIG. 3 is a cross-sectional view of the socket connector 10 in FIG. 1, and FIG. 4 is another cross-sectional view of the socket connector 10 in FIG. 1.

In this embodiment, the socket connector 10 is configured for the insertion of the plug connector 20. The socket connector 10 and the plug connector 20 support Power over Ethernet (PoE). The socket connector 10 is, for example, a RJ45 socket of an electronic device, and the plug connector 20 is, for example, a RJ45 plug. The socket connector 10 includes a housing 100, a circuit board 200, an electronic component 300, a plurality of contact elements 400, and a switch component 500.

The housing 100 includes a front housing 110, a seat 120, and a rear housing 130. The front housing 110 has an accommodation space 111. The seat 120 is fixed in the accommodation space 111 of the front housing 110. The rear housing 130 is fixed to the front housing 110 and located at a side of the accommodation space 111 of the front housing 110. The front housing 110, the seat 120 and the rear housing 130 together form an insertion hole 140 therebetween. The insertion hole 140 is configured for the insertion of the plug connector 20.

In this embodiment, the socket connector 10 may further include a plurality of contact terminals 600, and the rear housing 130 has a plurality of mount holes 131. The circuit board 200 is fixed in the insertion hole 140. The contact terminals 600 are fixed on the circuit board 200 and are respectively inserted into the mount holes 131 of the rear housing 130. The contact terminals 600 are configured to be respectively and in electrical contact with core wires 31 of a cable 30 that are respectively mounted on the mount holes 131.

The electronic component 300 is, for example, a light-emitting component, such as a light-emitting diode. The electronic component 300 is embedded in the seat 120 and exposed from a surface of the seat 120 facing toward the insertion hole 140.

The contact elements 400 are located in the insertion hole 140. The contact elements 400 are similar in structure. Each of the contact element 400 has a fixed end 410, a movable end 420, and a contact portion 430. The contact portion 430 of the contact element 400 is located between the fixed end 410 and the movable end 420. The fixed end 410 of the contact element 400 is fixed on the circuit board 200, and the movable end 420 of the contact element 400 is mounted to the seat 120 and is movable with respect to the circuit board 200. The contact portion 430 of the contact element 400 is configured to be in electrical contact with the plug connector 20. As shown in FIG. 3, two of the movable ends 420 of the contact elements 400 correspond to pins 310 of the electronic component 300.

The switch component 500 is made of electrical insulation material, such as plastic. The switch component 500 is located in the insertion hole 140 and is movably disposed on the seat 120. In specific, the seat 120 has two guide recesses 121 respectively located at two opposite sides of the seat 120, and the switch component 500 includes two side portions 510 and 520 and a middle portion 530 located between and connected to the side portions 510 and 520. The side portions 510 and 520 are respectively and movably mounted at the guide recesses 121 of the seat 120, and the middle portion 530 is in contact with the contact elements 400.

In this embodiment, the front housing 110 has an opening 141 connected to the insertion hole 140 and is at least defined by a first surface 112 and two second surfaces 113 and 114 of the front housing 110. Two opposite sides of the first surface 112 are respectively connected to the second surfaces 113 and 114. The side portion 510 of the switch component 500 has two protrusions 511 and 512, and the side portion 520 of the switch component 500 has two protrusions 521 and 522. The protrusions 511 and 512 of the side portion 510 are located close to the second surface 113 of the front housing 110, and the protrusions 521 and 522 of the side portion 520 are located close to the second surface 114 of the front housing 110, where the protrusion 511 is located closer to the second surface 113 of the front housing 110 than the protrusion 512, and the protrusion 521 is located closer to the second surface 114 of the front housing 110 than the protrusion 522. The protrusions 511, 512, 521, and 522 of the switch component 500 are located closer to the opening 141 connected to the insertion hole 140 than the contact portions 430 of the contact elements 400. The contact portions 430 of the contact elements 400 further protrude from the first surface 112 of the front housing 110 than the protrusions 511, 512, 521, and 522 of the switch component 500.

In this embodiment, the switch component 500 can be moved by the plug connector 20 during the insertion of the plug connector 20. And the movement of the switch component 500 caused by the insertion of the plug connector 20 can cause the movable ends 420 of the contact elements 400 to move away from the pins 310 of the electronic component 300, thereby causing the movable ends 420 to disconnect from the pins 310. Herein, defining that the movable ends 420 are movable between an electrical connection position and an electrical disconnection position by the switch component 500. As shown in FIGS. 3 and 4, when the movable ends 420 of the two contact elements 400 are in the electrical connection position, the protrusions 511, 512, 521 and 522 of the switch component 500 protrudes from the first surface 112 of the front housing 110, and the movable ends 420 of the two contact elements 400 are respectively electrically connected to the pins 310 of the electronic component 300. At this moment, the cable 30, the contact terminals 600, the circuit board 200, the two contact elements 400, and the electronic component 300 are electrically connected to one another, activating the electronic component 300.

Figure 5:
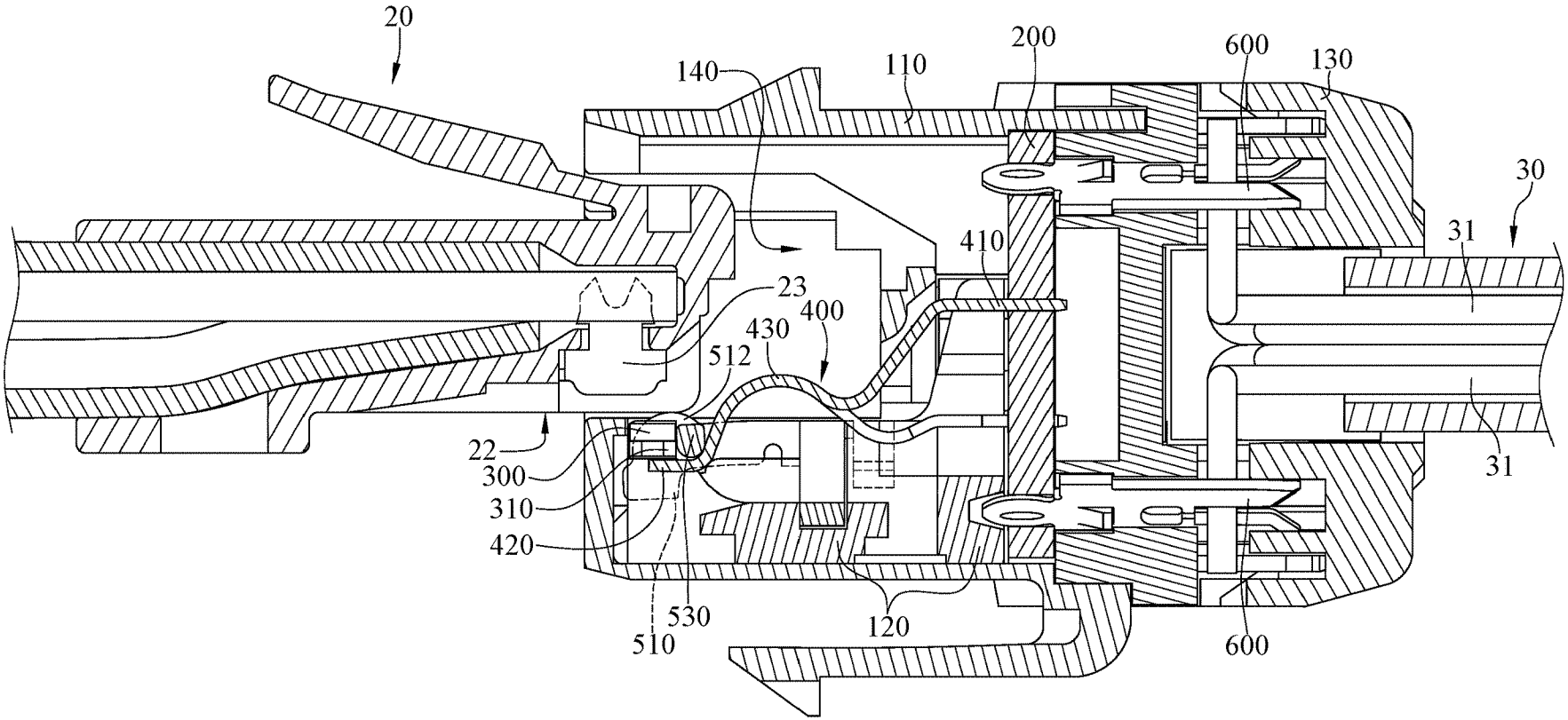
FIG. 5 is a cross-sectional view of the socket connector in FIG. 1 when the plug connector is not fully inserted into the socket connector.

Then, referring to FIGS. 1, 2 and further referring to FIG. 5, where FIG. 5 is a cross-sectional view of the socket connector 10 in FIG. 1 when the plug connector 20 is not fully inserted into the socket connector 10.

As shown, during the preliminary insertion of the plug connector 20 into the insertion hole 140 of the socket connector 10, the protrusion 512 of the side portion 510 and the protrusion 522 of the side portion 520 are respectively inserted into grooves 21 which are formed on the front end of the plug connector 20, and the protrusion 511 of the side portion 510 and the protrusion 521 of the side portion 520 are moved downwards by the front end and the bottom surface 22 of the plug connector 20. This causes the middle portion 530 of the switch component 500 to move towards the movable ends 420 of the contact elements 400 so as to disconnect the movable ends 420 from the pins 310 of the electronic component 300 (i.e., moving the movable ends 420 from the electrical connection position to the electrical disconnection position).

Note that the grooves 21 formed on the front end of the plug connector 20 are optional and the disclosure is not limited thereto; in some other embodiments, the front end of the plug connector may not have the grooves 21.

In addition, two pairs of protrusions on two opposite sides of the switch component 500 (i.e., the protrusions 511, 512, 521, and 522) ensure that the movement of the switch component 500 can be triggered by various plug connector having grooves 21 or without grooves 21. In detail, one or more of the protrusions may enter one or more grooves on the plug connector and therefore unable to be pushed by the plug connector, but the other protrusions not entering the groove will still have the interference with the plug connector to achieve the desired movement. That is, the protrusions 511, 512, 521 and 522 ensures that the position switching of the movable ends 420 of the contact elements 400 whether the existence or number of the groove on the plug connector.

As shown in FIG. 5, the movable ends 420 of the contact elements 400 are in the electrical disconnection position and spaced apart and electrically disconnected from the pins 310 of the electronic component 300, such that the electronic component 300 is turned off. In FIG. 5, the contact elements 23 of the plug connector 20 are not yet electrically connected to the contact elements 400 of the socket connector 10. That is, the electronic component 300 can be turned off before the plug connector 20 is actually electrically connected to the socket connector 10 by slightly inserting the plug connector 20.

Figure 6:
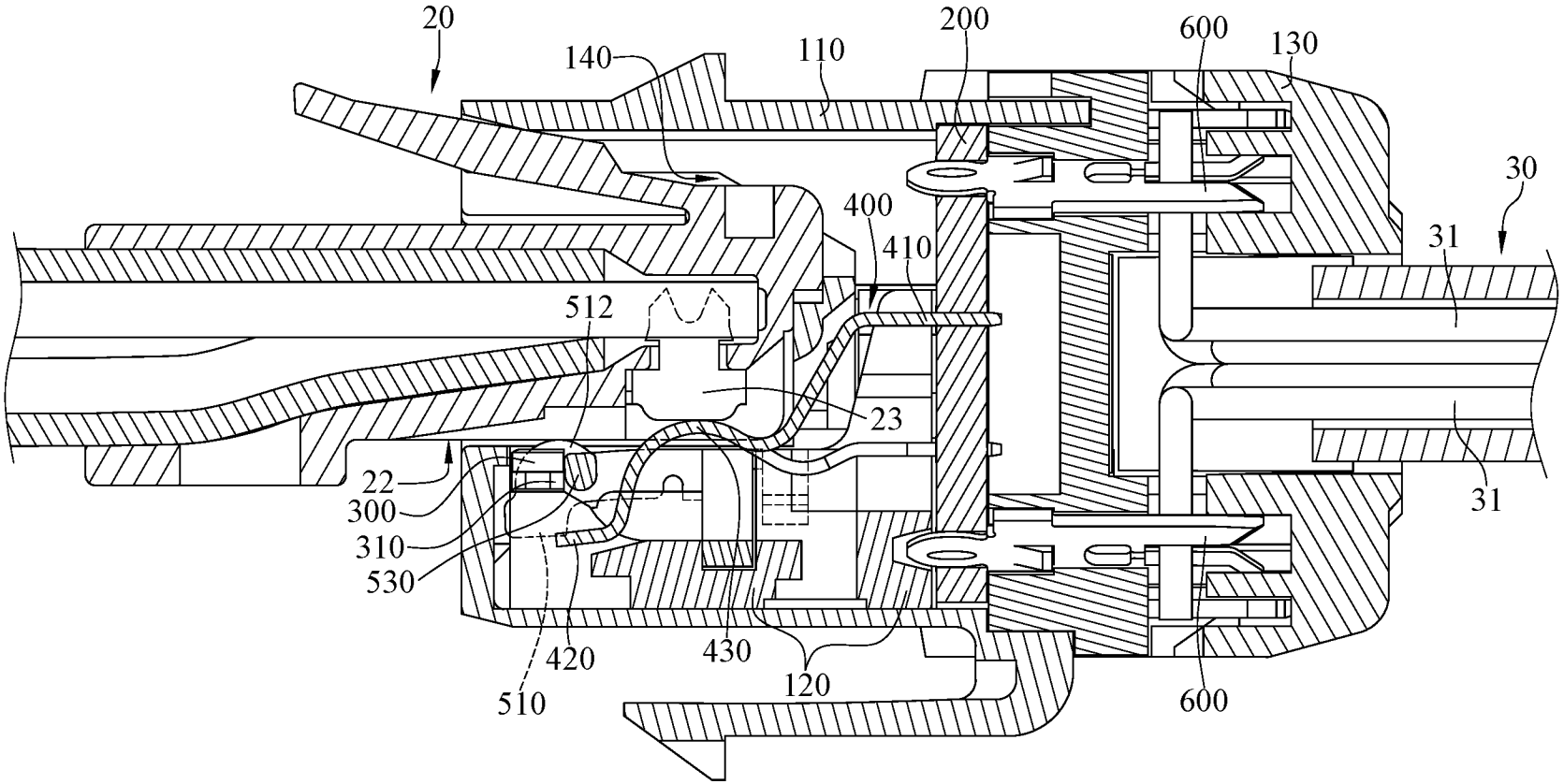
FIG. 6 is a cross-sectional view of the socket connector in FIG. 1 when the plug connector is fully inserted into the socket connector.

Referring to FIG. 6, where FIG. 6 is a cross-sectional view of the socket connector 10 in FIG. 1 when the plug connector 20 is fully inserted into the socket connector 10.

As shown, the plug connector 20 has been inserted further into the insertion hole 140 towards the desired position. The contact elements 23 of the plug connector 20 are in electrical contact with the contact portions 430 of the contact elements 400 of the socket connector 10, such that current can be transmitted between the plug connector 20, the socket connector 10, and the associated device connected thereto.

As discussed, during the insertion of the plug connector 20 into the socket connector 10, the movement of the plug connector 20 can switch the movable ends 420 of the contact elements 400 of the socket connector 10 to the electrical disconnection position to turn off the electronic component 300 before the plug connector 20 actually electrically connects with the contact elements 400 of the socket connector 10. As such, current transmitted between the plug connector 20 and the socket connector 10 will not be transmitted through the electronic component 300 so that the socket connector 10 is allowed to be adopted to the electronic devices requiring large current while preventing electronic component 300 from being damaged by high current.

On the other hand, when the plug connector 20 has been removed from the socket connector 10, the switch component 500 is not restricted by the plug connector 20, such that the contact elements 400 return to its original status to spring the switch components 500 back in position and to electrically connect with the pins 310 of the electronic component 300, thereby turning on the electronic component 300.

Figure 7:
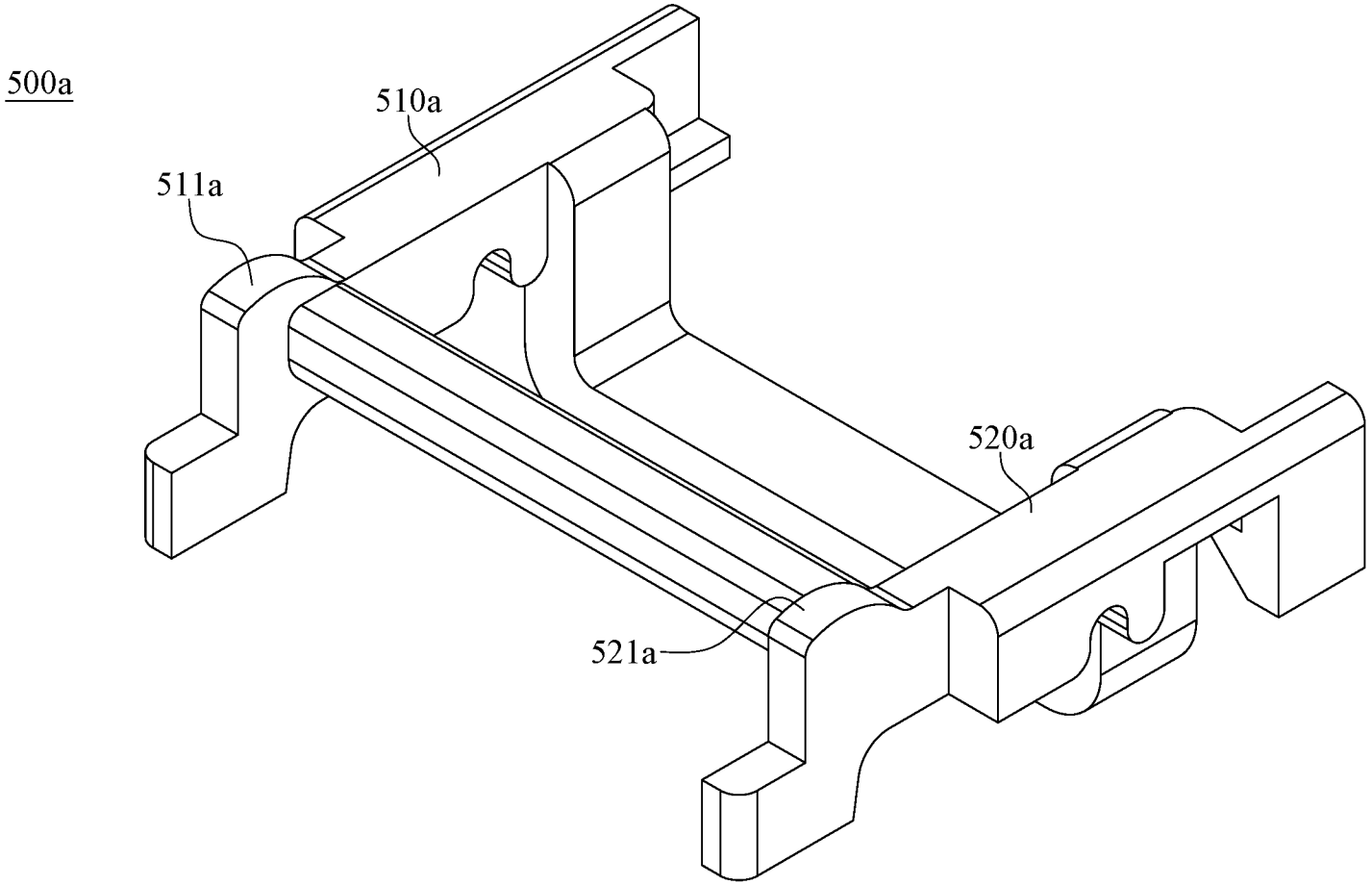
FIG. 7 is a perspective view of a switch component of a socket connector according to a second embodiment of the disclosure.

Note that the quantity of the protrusions on each side portion of the switch component is not restricted and may be altered as required. For example, referring to FIG. 7, where FIG. 7 is a perspective view of a switch component 500*a* of a socket connector according to a second embodiment of the disclosure. In this embodiment, the switch component 500*a* has two side portions 510*a* and 520*a*. The side portion 510*a* merely have one protrusion 511*a*, and the side portion 520*a* also merely have one protrusion 521*a*.

Figure 8:
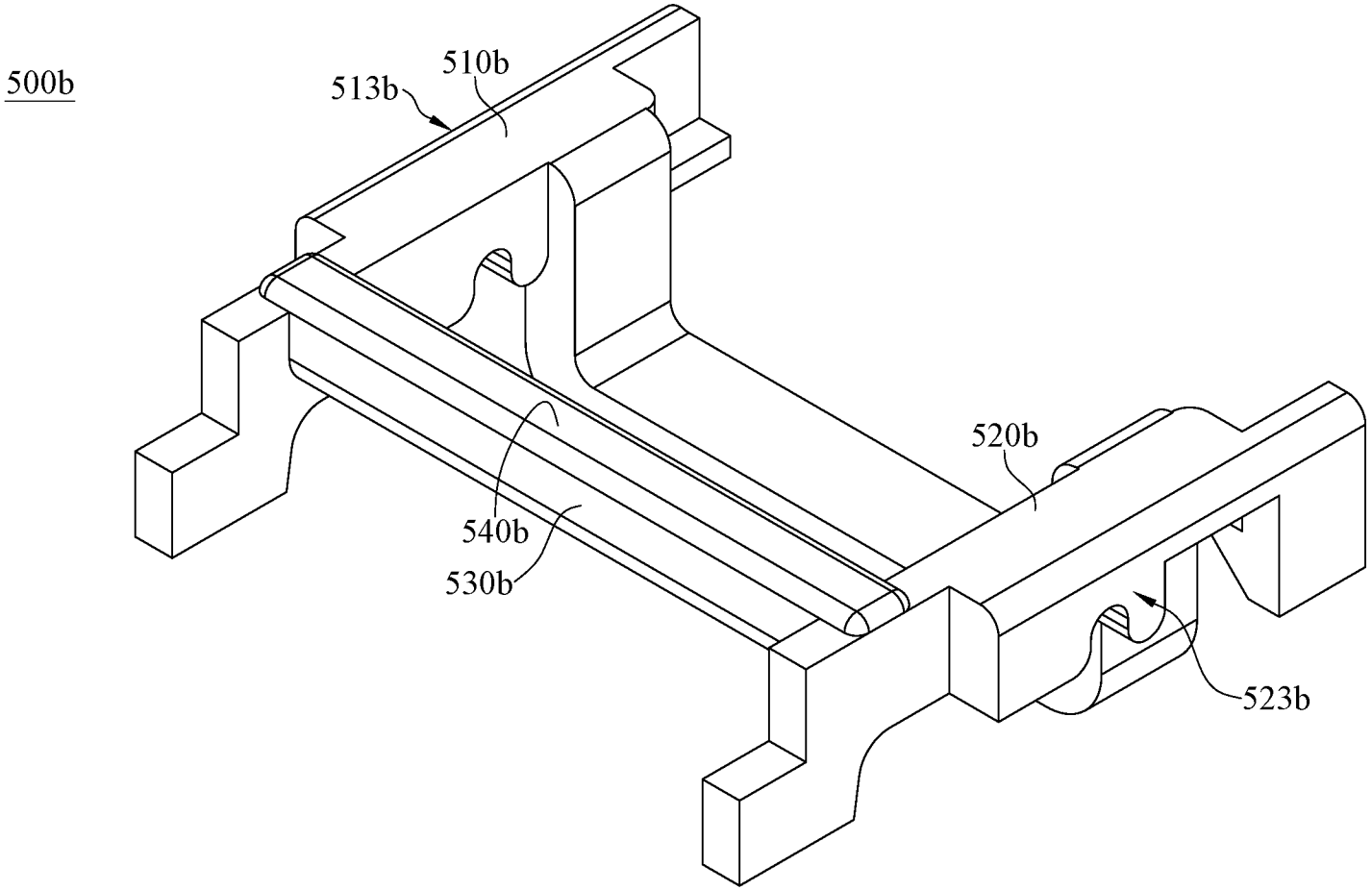
FIG. 8 is a perspective view of a switch component of a socket connector according to a third embodiment of the disclosure.

Note that the positions of the protrusions of the switch component are not restricted and may be altered as required. For example, referring to FIG. 8, where FIG. 8 is a perspective view of a switch component 500*b* of a socket connector according to a third embodiment of the disclosure. In this embodiment, a side portion 510*b* of the switch component 500*b* has a side surface 513*b*, and a side portion 520*b* of the switch component 500*b* has a side surface 523*b*. The side surfaces 513*b* and 523*b* of the side portions 510*b* and 520*b* respectively face the second surfaces 113 and 114 of the front housing 110 (shown in FIG. 2). A protrusion 540*b* of the switch component 500*b* extends from a side of the switch component 500*b* close to the second surface 113 of the front housing 110 towards another side of the switch component 500 close to the second surface 114 of the front housing 110. Specifically, the protrusion 540*b* of the switch component 500*b* extends from the second surface 513*b* of the side portion 510*b* to the second surface 523*b* of the side portion 520*b* via the middle portion 530*f* of the switch component 500*b*, but the present disclosure is not limited thereto; in some other embodiments, the protrusion of the switch component 500*b* may be extend from one side portion to another side portion via the middle portion of the switch component, and the protrusion of the switch component is spaced apart from the side surfaces of the side portions.

Figure 9:
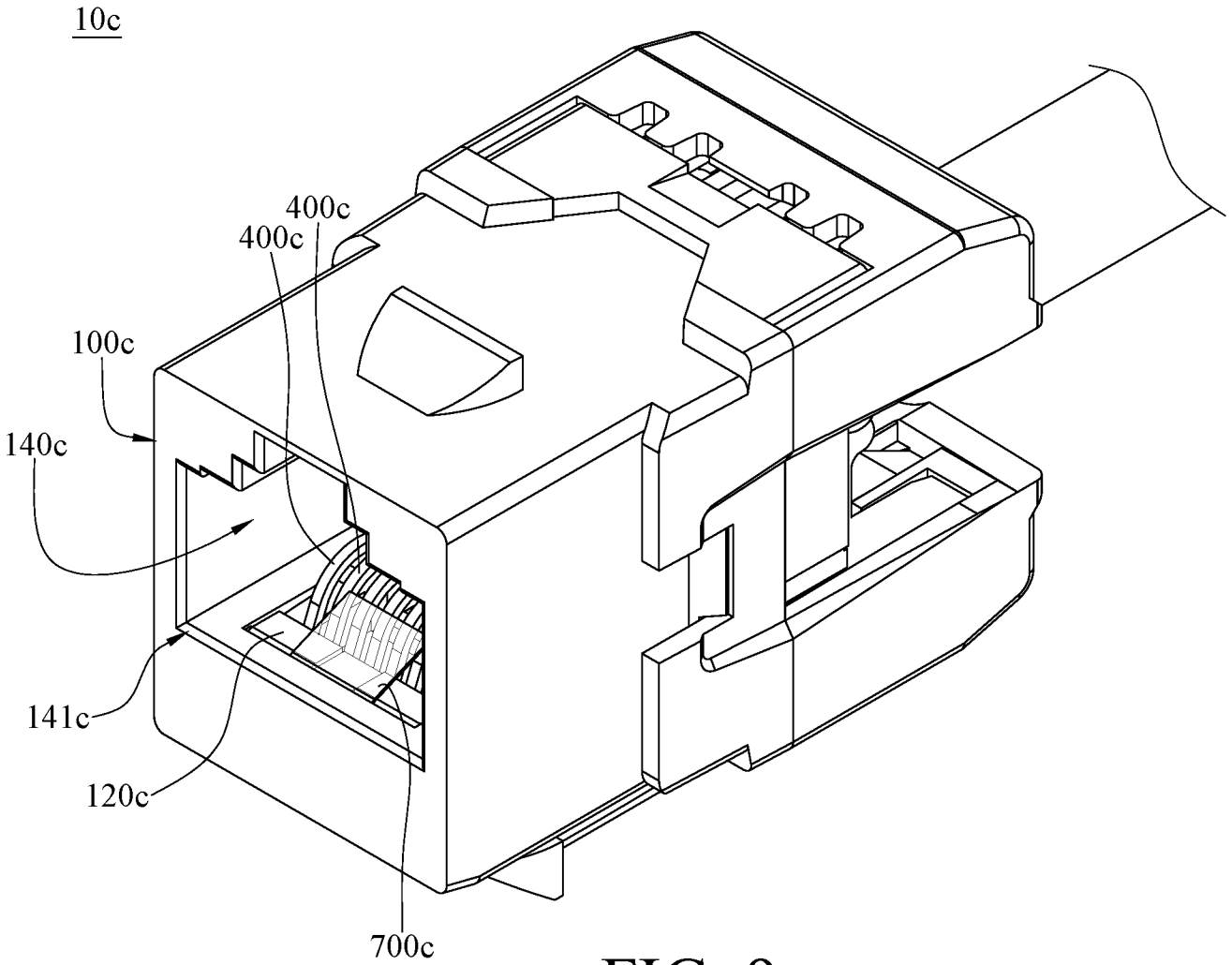
FIG. 9 is a perspective view of a socket connector according to a fourth embodiment of the disclosure.
Figure 10:
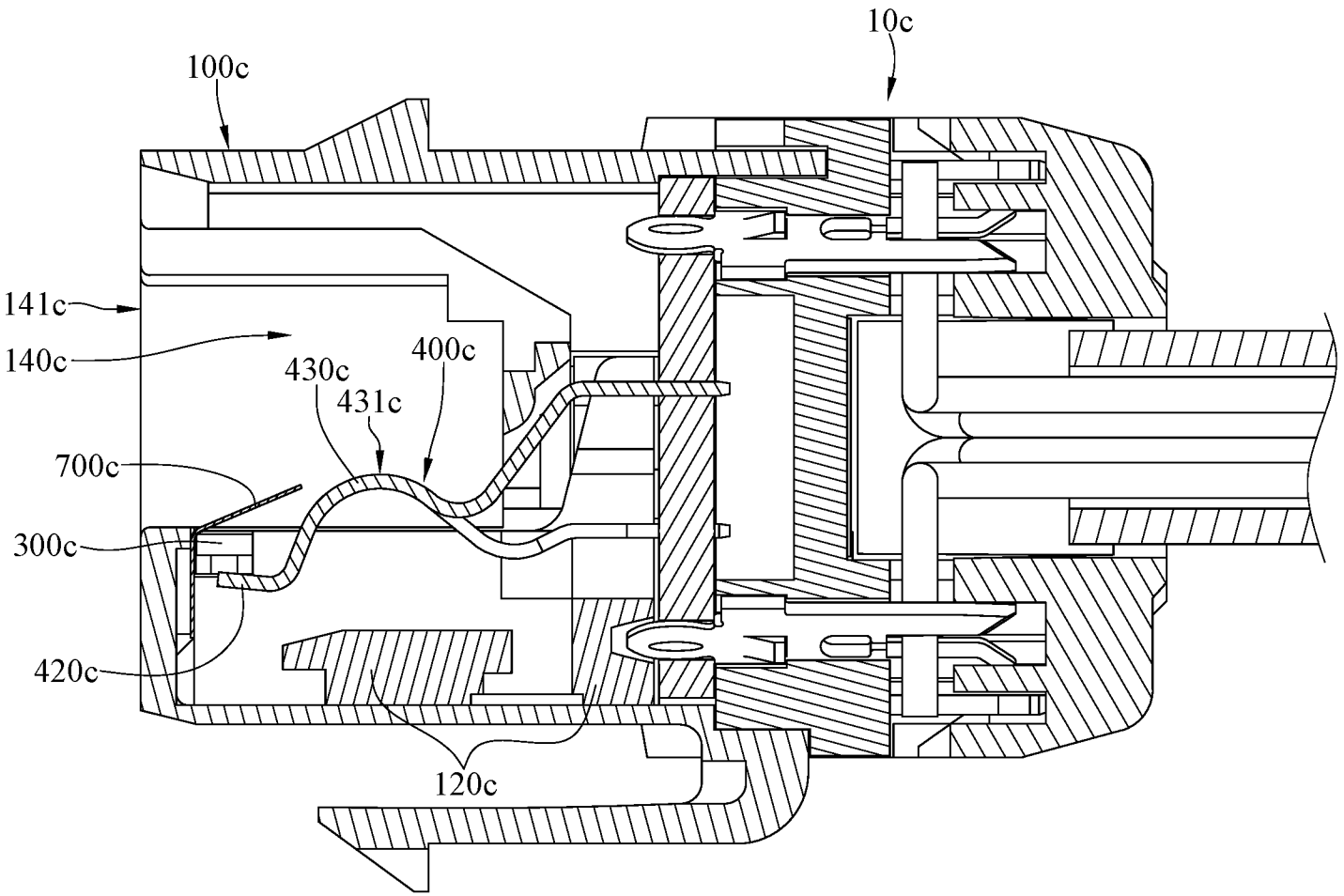
FIG. 10 is a cross-sectional view of the socket connector in FIG. 9.

Further, referring to FIGS. 9 and 10, where FIG. 9 is a perspective view of a socket connector 10*c* according to a fourth embodiment of the disclosure, and FIG. 10 is a cross-sectional view of the socket connector 10*c* in FIG. 9.

Note that the socket connector 10*c* is similar to the socket connector 10 of the previous embodiment, thus only the differences between these two embodiments will be illustrated below, and the same and similar parts will not be repeated.

In this embodiment, each of contact portions 430*c* of contact elements 400*c* has a contact point 431*c*. The socket connector 10*c* does not have the switch component but further include an electrical insulation component 700*c*. The electrical insulation component 700*c* is, for example, a mylar film. The electrical insulation component 700*c* is located in an insertion hole 140*c* of the socket connector 10*c* and is fixed on a seat 120*c* of a housing 100*c*. The electrical insulation component 700*c* is movably located between the contact points 431*c* of the contact elements 400*c* and an opening 141*c* of the housing 100*c* connected to the insertion hole 140*c* of the socket connector 10*c*.

Figure 11:
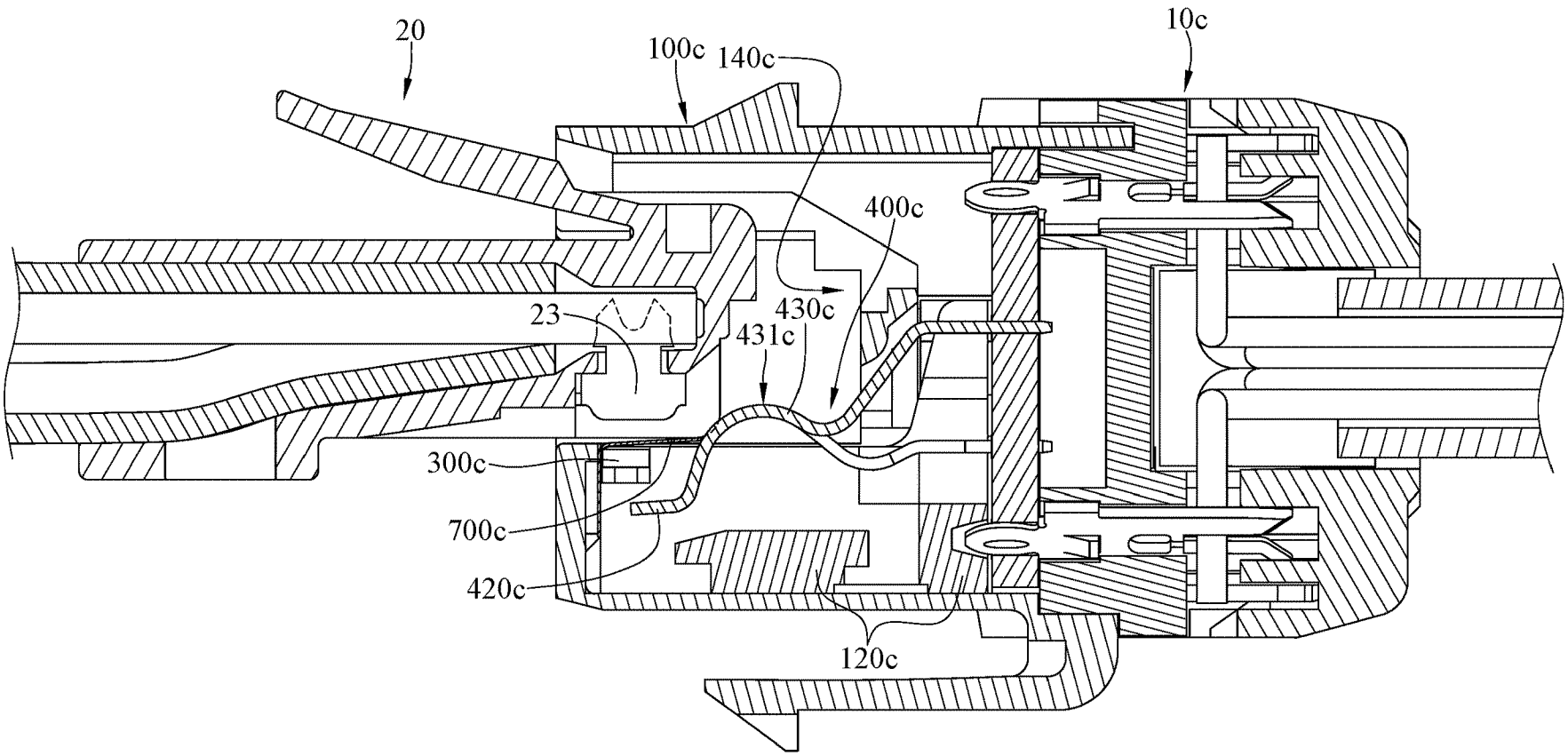
FIG. 11 is a cross-sectional view of the socket connector in FIG. 10 when a plug connector is not fully inserted into the socket connector.
Figure 12:
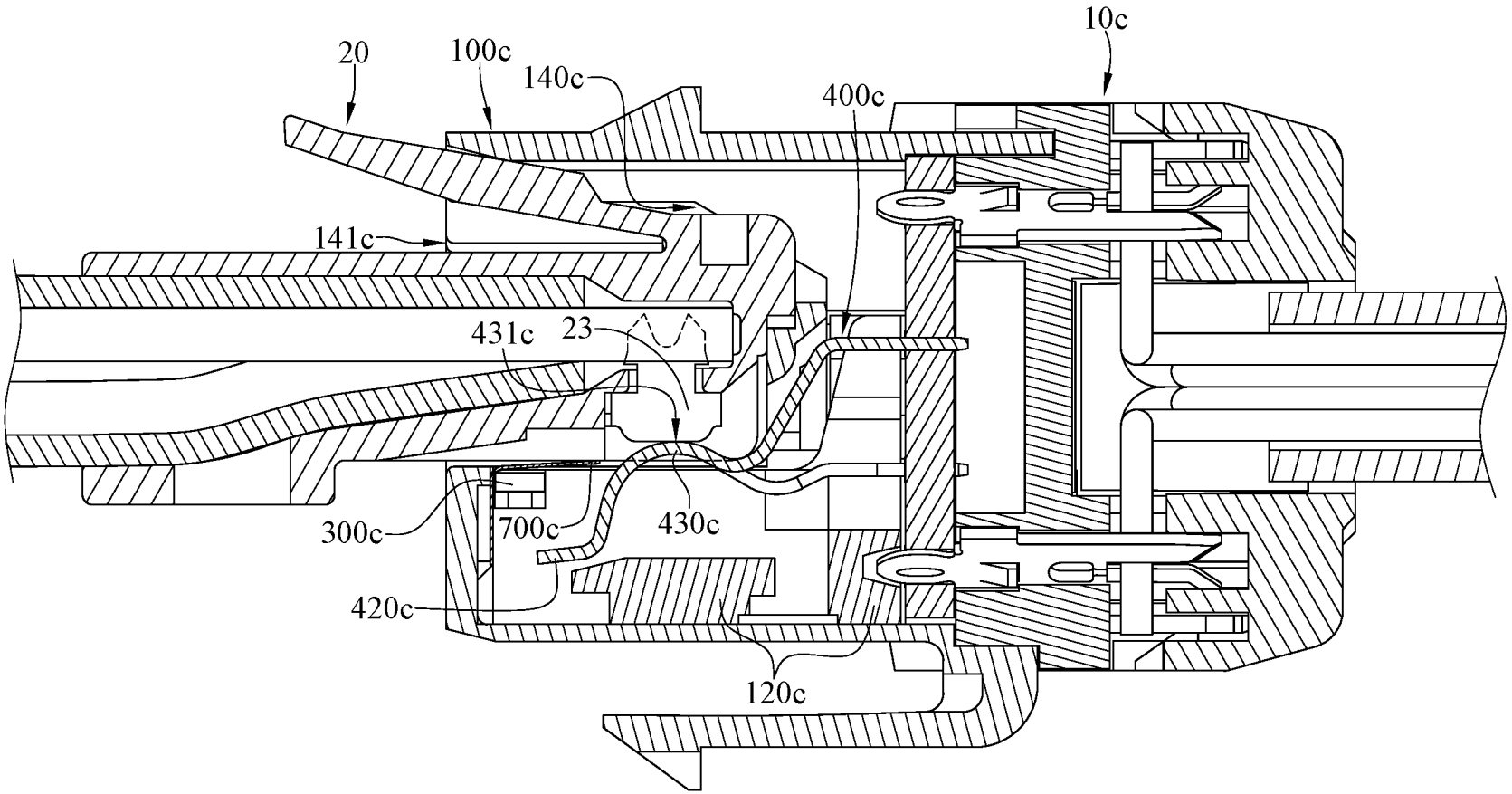
FIG. 12 is a cross-sectional view of the socket connector in FIG. 10 when the plug connector is fully inserted into the socket connector.

Then, referring to FIGS. 11 and 12, where FIG. 11 is a cross-sectional view of the socket connector 10*c* in FIG. 10 when the plug connector 20 is not fully inserted into the socket connector 10*c*, and FIG. 12 is a cross-sectional view of the socket connector 10*c* in FIG. 10 when the plug connector 20 is fully inserted into the socket connector 10*c*.

As shown in FIG. 11, during the preliminary insertion of the plug connector 20 into the insertion hole 140*c* of the socket connector 10*c*, the contact elements 400*c* are moved by the plug connector 20 so as to disconnect the movable ends 420*c* from the electronic component 300*c*. At this moment, the electrical insulation component 700*c* is located between contact elements 23 of the plug connector 20 and the contact elements 400*c* of the socket connector 10*c*, thus the contact elements 23 of the plug connector 20 is unable to be electrically connected to the contact elements 400*c* of the socket connector 10*c*; that is, the electrical insulation component 700*c* electrically insulates the contact elements 23 of the plug connector 20 from the contact elements 400*c* of the socket connector 10*c*.

Then, as shown in FIG. 12, the plug connector 20 has been inserted further into the insertion hole 140*c* towards the desired position. The contact elements 23 of the plug connector 20 are in electrical contact with the contact points 431*c* of the contact portions 430*c* of the contact elements 400*c* of the socket connector 10*c*, such that current can be transmitted between the plug connector 20, the socket connector 10*c*, and the associated device connected thereto.

On the other hand, when the plug connector 20 has been removed from the socket connector 10*c*, the contact elements 400*c* are not restricted by the plug connector 20, such that the contact elements 400*c* return to its original status to electrically connect with the electronic component 300*c*, thereby turning on the electronic component 300*c*.

According to the socket connectors as discussed above, during the insertion of the plug connector into the socket connector, the movement of the plug connector can switch the movable ends of the contact elements of the socket connector to the electrical disconnection position to turn off the electronic component before the plug connector actually electrically connects with the contact elements of the socket connector. As such, current transmitted between the plug connector and the socket connector will not be transmitted through the electronic component so that the socket connector is allowed to be adopted to the electronic devices requiring large current while preventing electronic component from being damaged by high current, thereby maintaining customer reactions and saving the cost spending on recalling damaged electronic device or compensating the customer.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A socket connector, configured for an insertion of a plug connector, comprising:

a housing, having an insertion hole configured for the insertion of the plug connector;

a circuit board, fixed in the insertion hole;

an electronic component, disposed in the insertion hole;

at least one contact element, located in the insertion hole, wherein the at least one contact element has a fixed end and a movable end, the fixed end is electrically connected to the circuit board, and the movable end is movable with respect to the circuit board; and a switch component, movably located in the insertion hole and being in contact with the at least one contact element;

wherein the switch component is configured to be movable by the plug connector so as to force the movable end of the at least one contact element to electrically connect to or disconnect from the electronic component, wherein the electronic component is a light-emitting component.

2. The socket connector according to claim 1, wherein the switch component is configured to be movable by the plug connector so as to switch the movable end of the at least one contact element between an electrical connection position and an electrical disconnection position; when the movable end of the at least one contact element is in the electrical connection position, the movable end is electrically connected to the electronic component; when the movable end of the at least one contact element is in the electrical disconnection position, the movable end is electrically disconnected from the electronic component.

3. The socket connector according to claim 2, wherein before the at least one contact element is electrically connected with the plug connector, the movable end of the at least one contact element is moved to the electrical disconnection position by being pushed by the switch component.

4. The socket connector according to claim 2, wherein the housing has a first surface and two second surfaces, two opposite sides of the first surface are respectively connected to the two second surfaces, the two second surfaces and the first surface together define an opening of the housing connected to the insertion hole, the switch component has at least one protrusion, the at least one protrusion of the switch component is configured to be pushed by the plug connector; when the movable end of the at least one contact element is in the electrical connection position, the at least one protrusion of the switch component protrudes from the first surface of the housing.

5. The socket connector according to claim 4, wherein the quantity of the at least one protrusion of the switch component is plural, and the protrusions of the switch component are respectively located close the second surfaces of the housing.

6. The socket connector according to claim 4, wherein the quantity of the at least one protrusion of the switch component is one, the protrusion extends from a side of the switch component close to one of the second surfaces of the housing towards another side of the switch component close to the other.

7. The socket connector according to claim 4, wherein the at least one contact element further has a contact portion configured to be in contact with the plug connector, and the contact portion further protrudes from the first surface of the housing than the at least one protrusion of the switch component.

8. The socket connector according to claim 4, wherein the at least one contact element further has a contact portion configured to be in contact with the plug connector, the at least one protrusion of the switch component is located closer to the opening of the housing connected to the insertion hole than the contact portion of the at least one contact element.

9. A socket connector, configured for an insertion of a plug connector, comprising:

a housing, having an insertion hole configured for the insertion of the plug connector;

a circuit board, fixed in the insertion hole;

an electronic component, disposed in the insertion hole;

at least one contact element, located in the insertion hole, wherein the at least one contact element has a fixed end, a movable end and a contact point, the fixed end is electrically connected to the circuit board, the movable end is movable with respect to the circuit board, the contact point is located between the fixed end and the contact point, the contact element is configured to be movable by the plug connector so as to force the movable end of the at least one contact element to electrically connect to or disconnect from the electronic component; and an electrical insulation component, disposed in the insertion hole and movably located between the contact point of the at least one contact element and an opening of the housing connected to the insertion hole;

wherein before the contact point of the at least one contact element of the socket connector is in electrical contact with at least one contact element of the plug connector, the electrical insulation component separates the at least one contact element of the plug connector from the at least one contact element of the socket connector, wherein the electronic component is a light-emitting component.

* * * * *